US005904348A

United States Patent [19]

Sevy et al.

[11] Patent Number: 5,904,348

[45] Date of Patent: May 18, 1999

[54] BODY-LOCKING HOLDDOWN DEVICE

[75] Inventors: James H. Sevy, Bear, Del.; Cole D. Hill, Drumore, Pa.

[73] Assignee: Chrysler Corporation, Auburn Hills, Mich.

[21] Appl. No.: 08/867,786

[22] Filed: Jun. 3, 1997

[51] Int. Cl.[6] ..... B25B 1/14

[52] U.S. Cl. ..... 269/228; 269/236

[58] Field of Search ..... 269/228, 236, 269/235, 232, 257

[56] References Cited

U.S. PATENT DOCUMENTS 1,890,042 12/1932 Morandi ..... 269/228

4,884,792 12/1989 Rendahl et al. ..... 269/236

5,133,538 7/1992 Maeda et al. ..... 269/309

*Primary Examiner*—Timothy V. Eley

*Assistant Examiner*—Benjamin Halpern

*Attorney, Agent, or Firm*—Lawrence J. Shurupoff

[57] ABSTRACT

A holddown device has a clamp arm pivoted on a base. The clamp arm has a hook end extending outwardly from the pivot. A tail extends outwardly from the pivot at an acute angle to the hook end. A cam is pivoted on the base. The cam has a camming periphery engaging the tail. The cam is rotatable in one direction to a locking position and in the opposite direction to a release position. The cam, upon rotation to the locking position, swings the clamp arm from a retracted position to a clamping position. A link pivotally interconnects the cam and the tail of the clamp arm.

2 Claims, 3 Drawing Sheets

BODY-LOCKING HOLDDOWN DEVICE

FIELD OF THE INVENTION

This invention relates generally to holddown devices and more particularly to a body-locking holddown device.

BACKGROUND AND SUMMARY OF THE INVENTION

Although the holddown device of this invention has general utility, it is designed primarily to clamp a car body on a carrier which moves through a cleaner dip tank and a primer dip tank before the car body is painted. The carrier must be lowered into and raised from each dip tank and it may also be tilted one way and another. One or more clamps are provided to secure the car body to the carrier. The car body must be securely clamped, and the clamps must not fail, yet they should be easy to operate.

In the specific embodiment about to be described, a clamp arm is pivoted to a base for movement between a retracted position and a clamping position. The clamp arm has a hook end extending outwardly from the pivot, and a tail extending outwardly from the pivot at an acute angle to the hook end. A cam is pivoted to the base beneath the hook arm and has a camming periphery engageable with the tail of the clamp arm. The cam is rotatable in one direction to a locking position and in the opposite direction to a release position. When the cam is rotated to its locking position, it swings the clamp arm to its clamping position. A link interconnects the tail of the clamp arm and the cam. When the cam is rotated to its release position, the link returns the clamp arm to its retracted position.

When the cam rotates the clamp arm to its clamping position, there is a reaction force against the cam. The shape of the cam periphery and the tail of the clamp arm at the point of contact are such that the reaction force has a vector which extends on a straight line through the cam pivot. This insures that the clamp arm is securely locked in its clamping position without any tendency to release.

One object of this invention is to provide a holddown device having the foregoing features and capabilities.

Another object is to provide a holddown device which is constructed of a relatively few simple parts, is rugged and durable in use, and is capable of being inexpensively manufactured and assembled and is easy to operate.

Other objects, features and advantages of the invention will become more apparent as the following description proceeds, especially when considered with the accompanying drawings.

DETAILED DESCRIPTION OF THE PREFERRED EMBODIMENT

Figure 1:
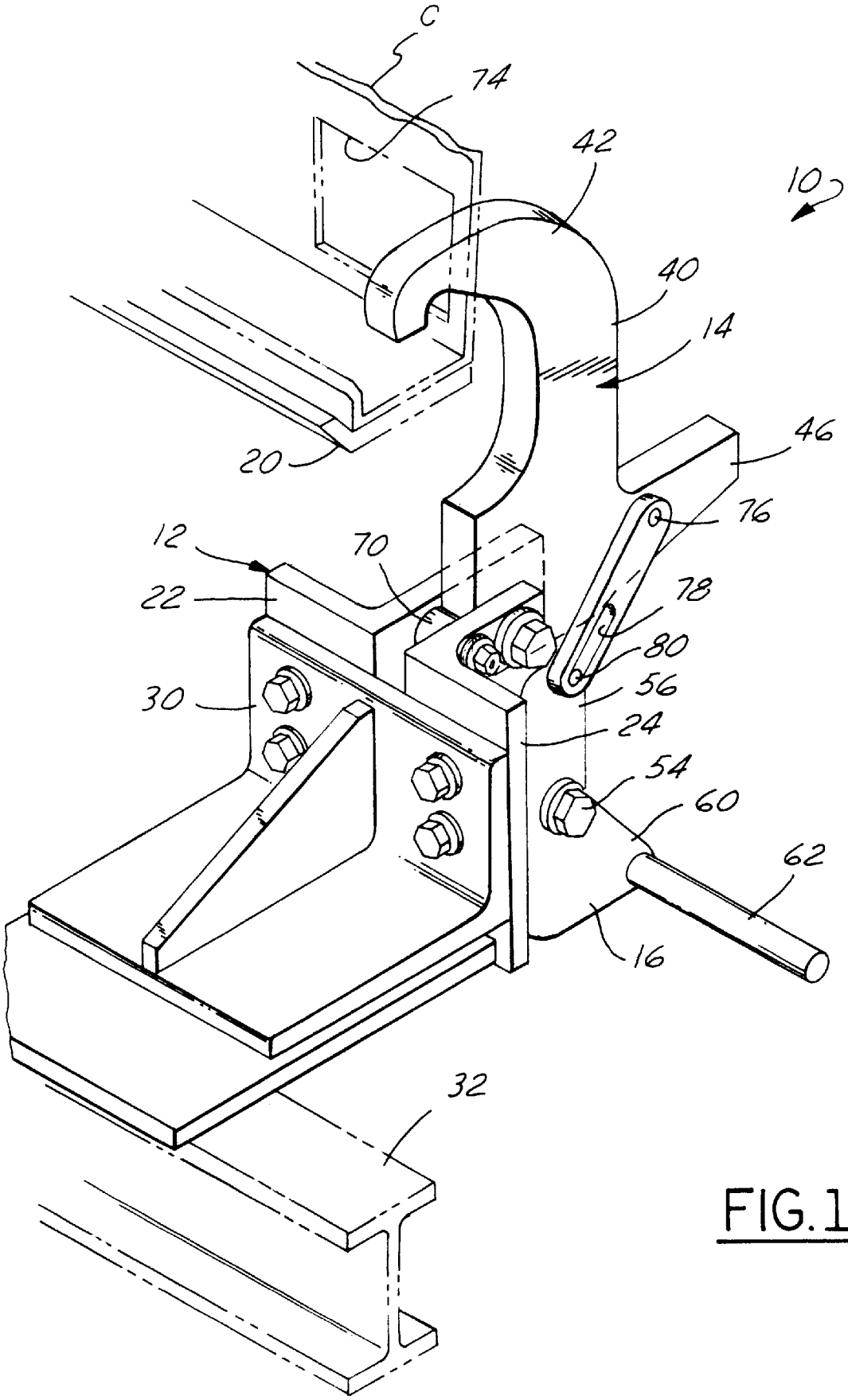
FIG. 1 is a perspective view of a holddown device constructed in accordance with the invention, showing the clamp arm in its clamping position engaging a car body on a carrier.
Figure 2:
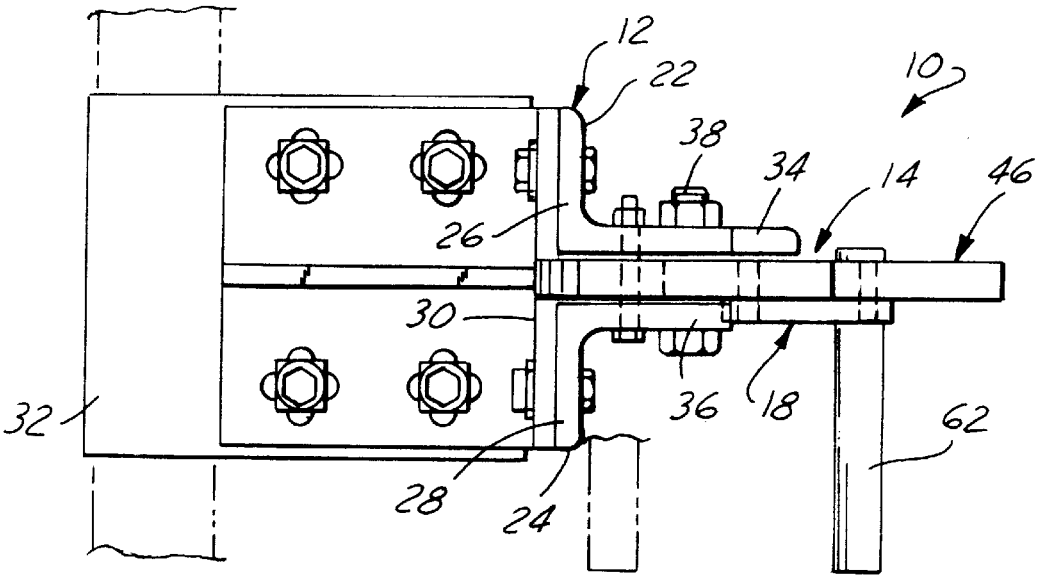
FIG. 2 is a top plan view of the holddown device shown in FIG. 1.

Referring now more particularly to the drawings, a holddown device 10 is shown having a base 12, a clamp arm 14, a cam 16 and a link 18 interconnecting the clamp arm and the cam. The holddown device 10 is adapted to clamp a car body C on a carrier 20.

The base 12 has two generally L-shaped brackets 22 and 24. The brackets 22 and 24 have co-planar flanges 26 and 28, respectively, bolted or otherwise secured to a plate 30 on rigid support structure 32. The brackets 22 and 24 have vertical flanges 34 and 36 which extend outwardly from flanges 26 and 28 in laterally spaced-apart parallel relation.

The clamp arm 14 is in the form of a flat plate disposed in the space between the flanges 34 and 36 and pivoted thereto on a pivot pin 38 which extends horizontally from one such flange to the other. The clamp arm 14 has an elongated hook end 40 which extends outwardly from the pivot pin 38 and terminates in a generally C-shaped portion 42 having a tip 44 at its extreme outer end. The clamp arm 14 also has a tail 46 which extends outwardly from the pivot point 38 at an acute angle to the hook end 40. The bottom surface 48 of the tail has inner and outer surface portions 50 and 52.

The cam 16 is in the form of a flat plate located beneath the clamp arm 14 and pivoted to the flange 34 of the base on a horizontal pivot pin 54. The cam 16 has a nose 56 extending outwardly from the pivot pin 54, provided with a convexly curved camming periphery 58. The cam 16 has an extension 60 at the opposite side of the pivot pin 54 provided with a laterally outwardly extending handle 62 for manually turning the cam about its pivot. The camming periphery 58 of the cam engages the bottom surface 48 of the tail 46 of clamp arm 14.

Figure 3:
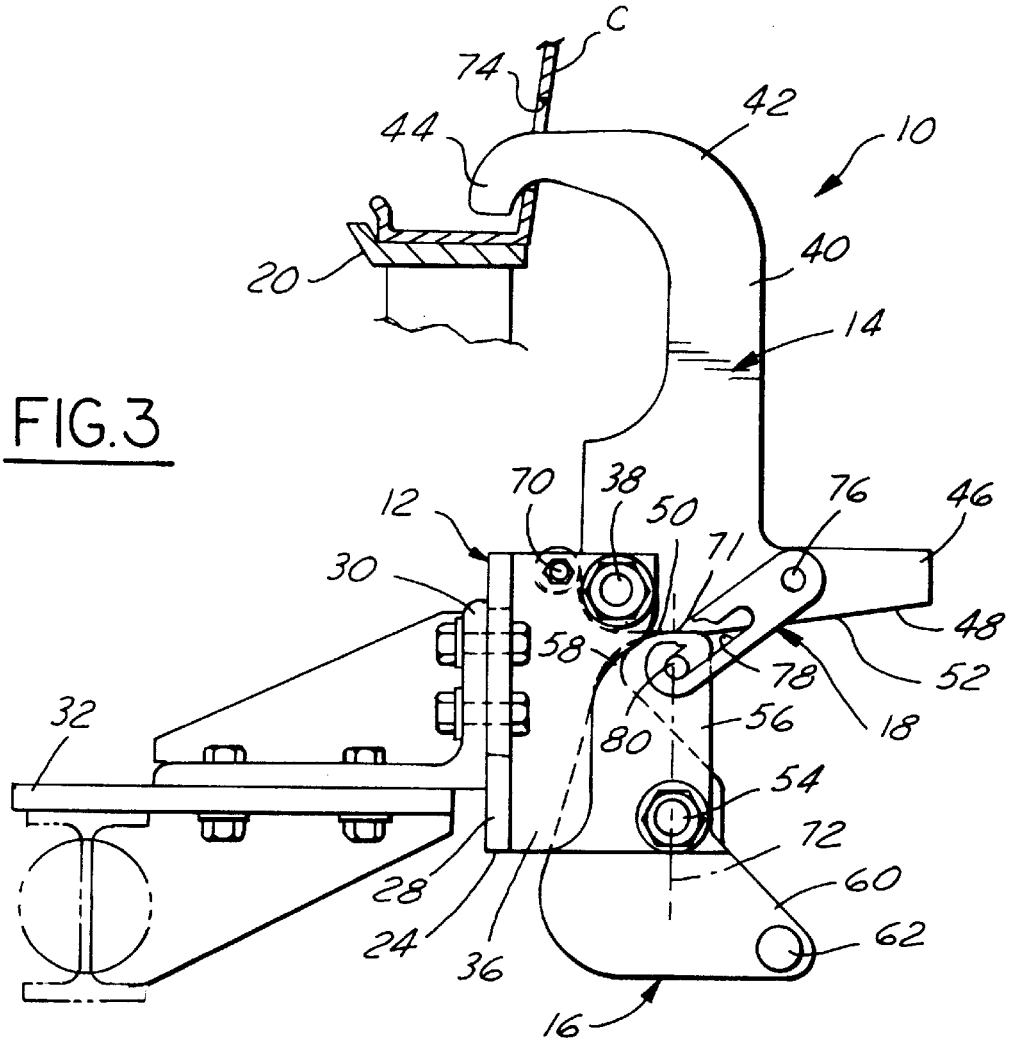
FIG. 3 is a side elevational view of the holddown device showing the clamp arm in its clamping position, with parts broken away.
Figure 4:
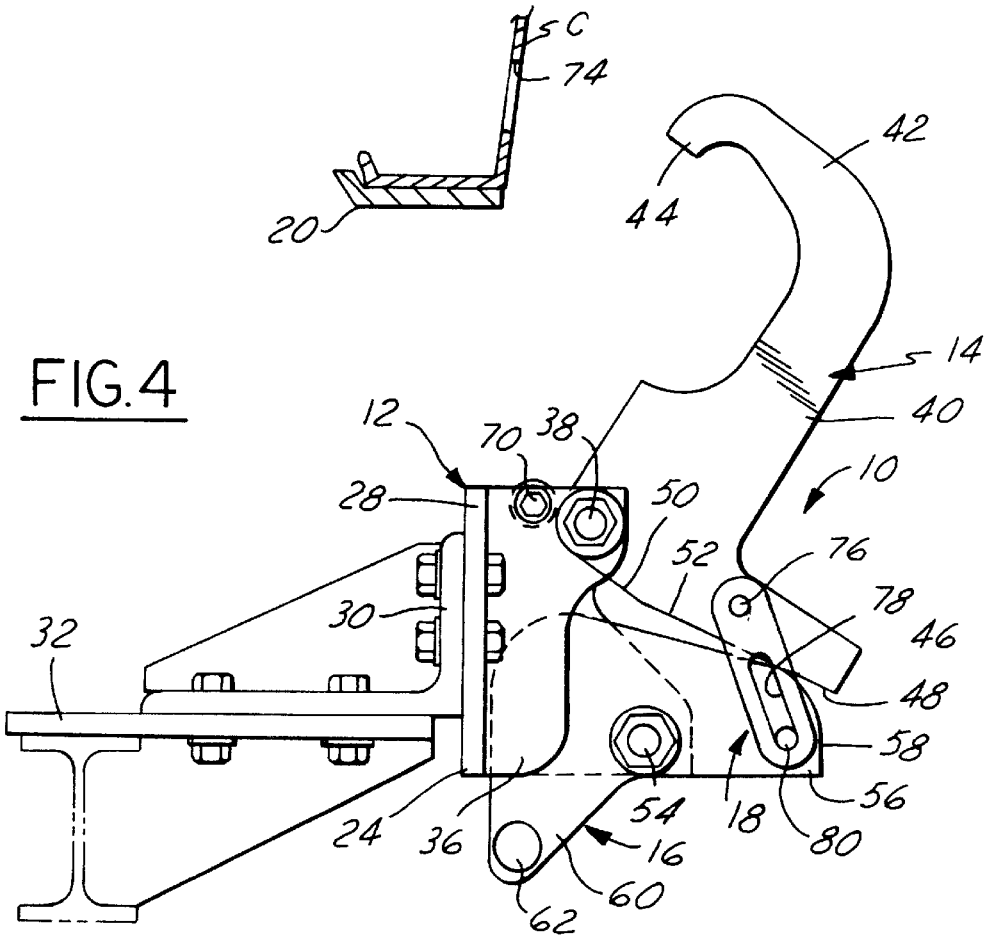
FIG. 4 is a view similar to FIG. 3 but showing the clamp arm in the released position.
Figure 5:
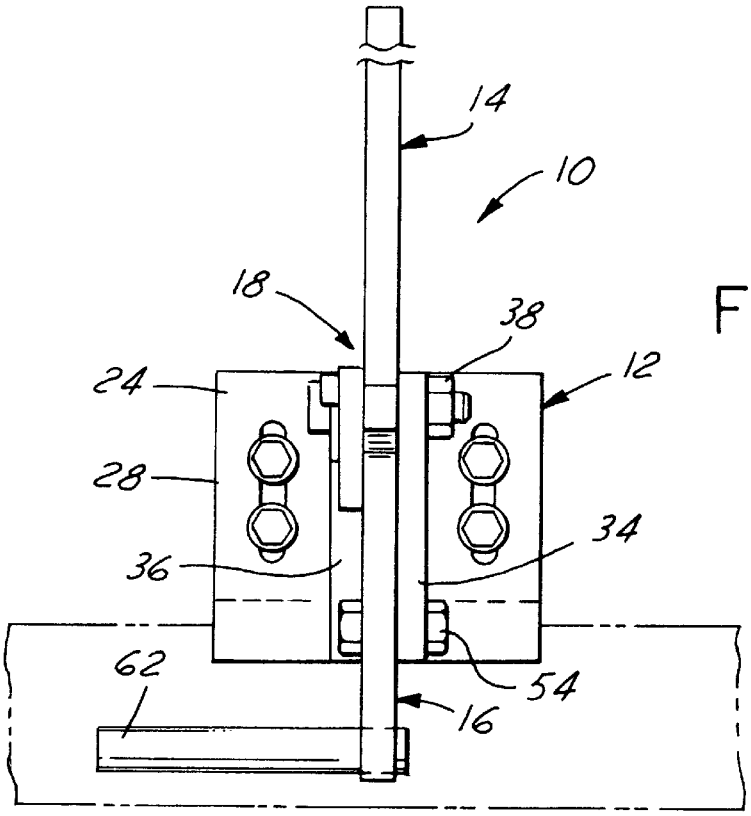
FIG. 5 is a view of the holddown device as seen from the right in FIG. 4.

The cam 16 is rotatable counterclockwise from the release position shown in FIG. 4 to the locking position shown in FIG. 3. The cam, upon rotation to its locking position of FIG. 3, is operative to swing the clamp arm 14 counterclockwise from the retracted position of FIG. 4 to the clamping position of FIG. 3. As the cam 16 rotates from its release position to it locking position, the periphery 58 of its nose 56 is in continuous contact with the bottom surface 48 of the tail 46 of the clamp arm.

In its clamping position, the clamp arm 16 engages a stop pin 70 which extends horizontally between the flanges 34 and 36 at a point to the rear of and on a level slightly above the pivot pin 38. The stop pin 70 prevents movement of the clamp arm 14 beyond the vertical clamping position shown in FIG. 3.

In the clamping position of FIG. 3, the nose 56 of the cam engages the inner surface portion 50 of the tail of the clamp arm. In the FIG. 3 position, the surface 50 of the tail of the clamp arm is horizontal and the periphery of the nose of the cam engages this horizontal inner surface portion 50 under pressure at the contact point 71 shown in FIG. 3. There is a reaction force at the contact point 71, and this reaction force has a vector 72 which is substantially vertical as shown in FIG. 3. The reaction force vector 72 in the clamping position of the clamp arm 14 passes through the pivot pin 54 for the cam and accordingly the reaction force does not tend to turn the cam. The cam thus provides a solid lock for holding the clamp arm in the clamping position.

In the clamping position, the tip 44 of the C-shaped portion 42 of the clamp arm 14 extends through an opening 74 in the car body C and engages the car body at that opening to securely anchor the car body and prevent it from moving as it is transported through a dip tank. Other similar holddown devices are usually provided to clamp the car body at different locations.

The link 18 is an elongated plate-like member, one end of which is pivoted to the tail 46 of the clamp arm by a pivot pin 76. The link has an elongated slot 78 extending lengthwise of the link from a point adjacent the opposite end of the link. A pivot pin 80 extending outwardly from the nose 56 of the cam is engaged in the slot 78. The pin and slot provide a lost-motion connection permitting the cam to rotate from its FIG. 3 locking position to its FIG. 4 release position and withdraw the clamp arm 14 to its retracted position. In the locking position of FIG. 3, the pin 80 on the nose 56 of the cam is at the outer end of the slot 78.

We claim:

1. A body-locking holddown device comprising a base adapted to be fixedly attached to a support, a clamp arm, a first pivot pivotally connecting said clamp arm to said base, said clamp arm having a hook end extending outwardly from said first pivot, said hook end terminating in a C-shaped portion opening in a first direction, said clamp arm having a tail extending outwardly from said first pivot at an acute angle to said hook end in a second direction opposite to said first direction, a cam, a second pivot spaced from said first pivot pivotally connecting said cam to said base, said cam having a camming periphery engaging said tail, said cam being rotatable in one direction to a locking position and in a direction opposite to said one direction to a release position, said cam, upon rotation thereof to said locking position, being operative to swing said clamp arm from a retracted position to a clamping position, a link having a first pivotal connection to said cam and a second pivotal connection to the tail of said clamp arm, one of said pivotal connections being a lost-motion connection, and a stop on said base engagable with said clamp arm to limit movement of said clamp arm beyond the clamping position thereof, wherein, in the clamping position of said clamp arm, the periphery of said cam engages the tail of said clamp arm at a contact point under pressure, producing a reaction force of the tail against the cam, the shape of the periphery of the cam and of the tail of the clamp arm at said contact point being such that the reaction force has a force vector which extends from the contact point on a straight line through the second pivot.

2. A holddown device as defined in claim 1, wherein said first pivotal connection is the lost-motion connection and comprises a pin on said cam received in an elongated slot in said link.

* * * * *